US005490327A

United States Patent [19]

Ohori

[11] Patent Number: 5,490,327

[45] Date of Patent: Feb. 13, 1996

[54] RETAINER FOR A NAIL CLIPPER

[76] Inventor: Hiroshi D. Ohori, P.O. Box W, Cedar Knolls, N.J. 07927

[21] Appl. No.: 342,578

[22] Filed: Nov. 21, 1994

[51] Int. Cl.[6] ..... A45D 29/02

[52] U.S. Cl. ..... 30/28; 132/75.5

[58] Field of Search ..... 30/26, 27, 28, 30/29; 132/75.5

[56] References Cited

U.S. PATENT DOCUMENTS

| | | | |
|---|---|---|---|
| 3,943,948 | 3/1976 | Sartore | 30/28 X |
| 4,550,496 | 11/1985 | Reinicke | 30/28 X |
| 4,940,136 | 7/1990 | Miller et al. | 30/28 X |
| 5,031,765 | 7/1991 | Chen | 30/28 X |
| 5,150,521 | 9/1992 | Han | 30/28 |
| 5,195,544 | 3/1993 | Campagna | 30/28 X |
| 5,323,537 | 6/1994 | Ohori | 30/28 |

*Primary Examiner*—Rinaldi I. Rada
*Assistant Examiner*—Jay A. Stelacone
*Attorney, Agent, or Firm*—McAulay Fisher Nissen Goldberg & Kiel

[57] ABSTRACT

The plastic retainer is of skeletal construction sized to receive a nail clipper. The side walls of the retainer receive the nail clipper in friction fit manner and define a chamber to receive nail clippings. In addition, the forward end of the nail clipper is received in a recessed position with the jaws of the nail clipper behind a front wall of the retainer. The forward end of the nail clipper can be moved to a raised operating position with the jaws of the nail clipper above the front wall and in an exposed position for nail cutting purposes. Projections are provided on the retainer at the forward end to prevent the forward end of the nail clipper from moving out of the retainer when being raised into the raised operating position.

20 Claims, 3 Drawing Sheets

FIG. 6
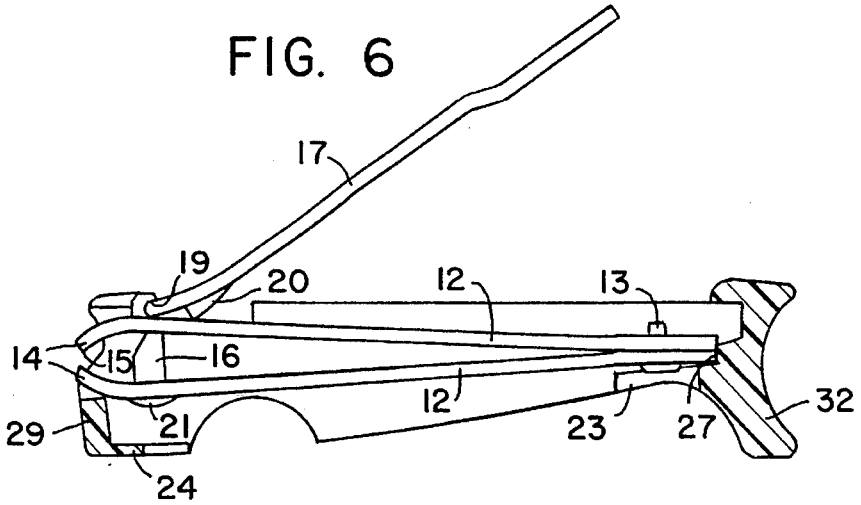
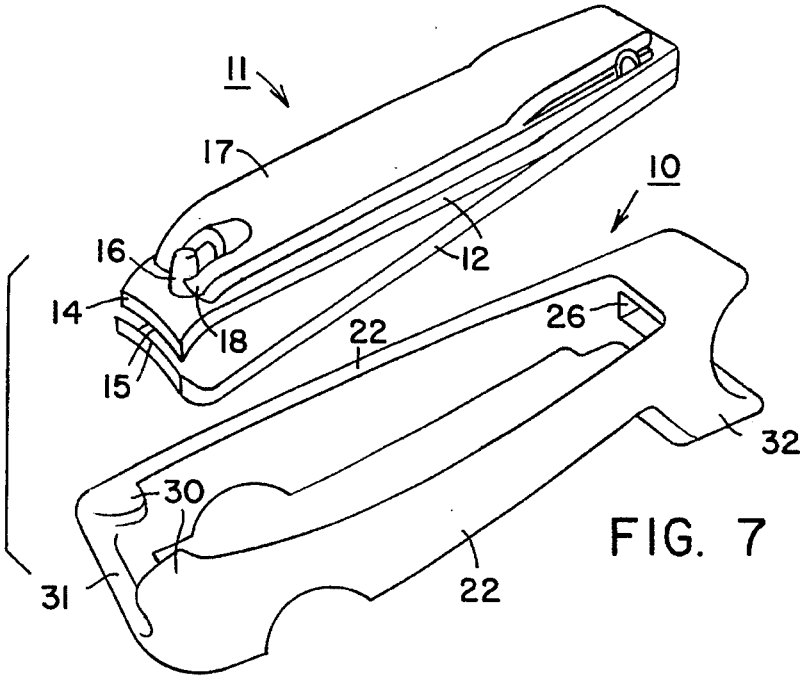
FIG. 7
FIG. 8
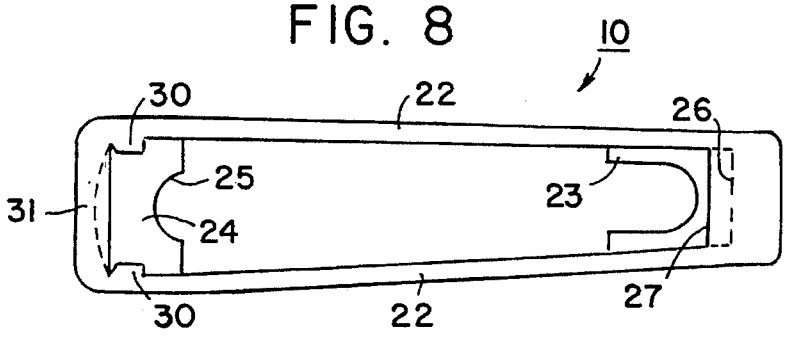

FIG. 9
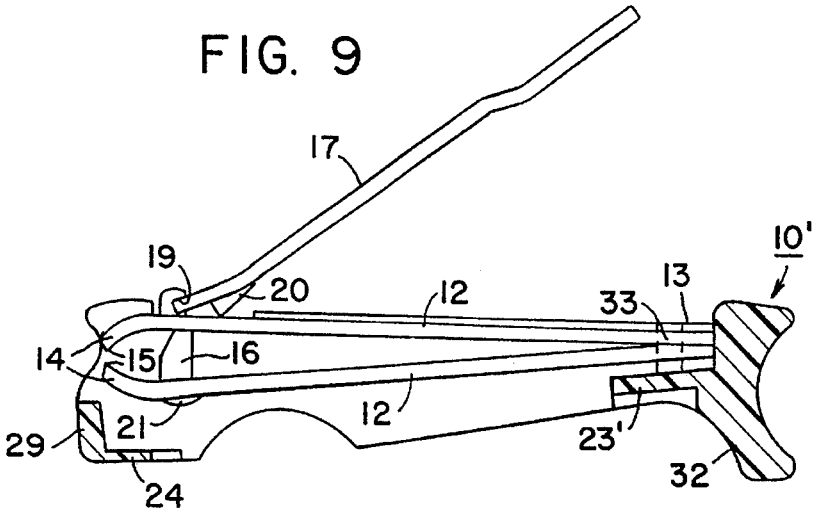
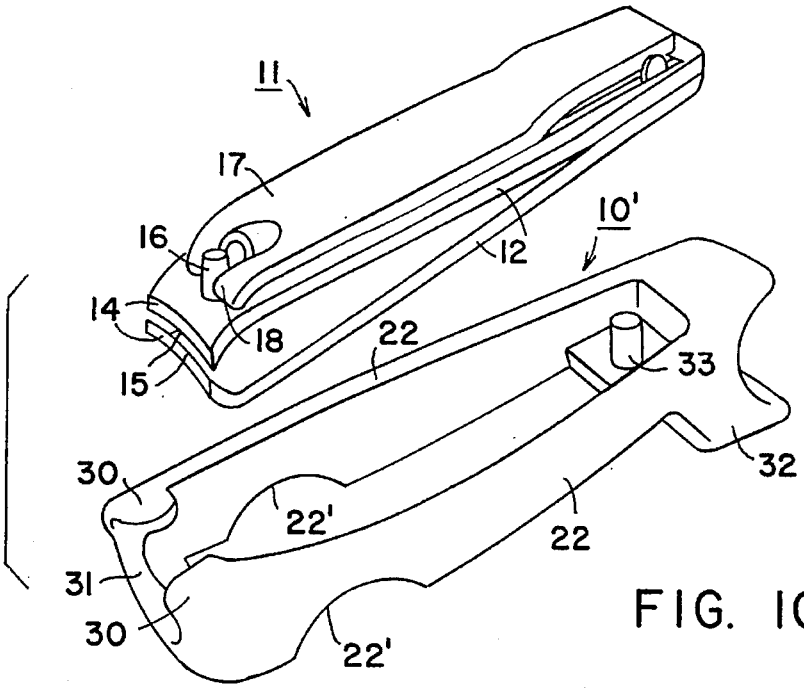
FIG. 10
FIG. 11
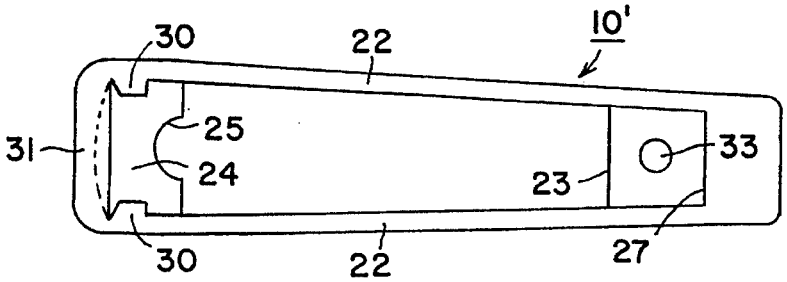

RETAINER FOR A NAIL CLIPPER

This invention relates to a retainer for a nail clipper.

As is known, nail clippers, for example for finger nails and toe nails, have generally been constructed of a pair of elongated bars which are secured together at one end and which carry sharp jaws at the opposite end for the clipping of nails. Usually, a pivotally mounted lever is incorporated in the clipper so as to bring the jaws together in a clipping relationship.

As is also known, when exposed, the sharp jaws of a nail clipper may inadvertently cut or nick the skin of the person handling the nail clipper. In addition, if placed in a pocket or purse in an unexposed condition, the sharp jaws may damage other articles in the pocket or purse. Accordingly, various attempts have been made to provide covers or guards for such nail clippers, for example as described in U.S. Pat. No. 4,788,768. Further, various types of casings have been provided for receiving a nail clipper in a protective manner, for example as described in U.S. Pat. Nos. 5,031,765; 3,943,948 and 3,855,698.

It has also been known to provide finger grip housings which can be secured to a nail clipper to facilitate handling of the nail clipper when in use.

However, the previously known structures have not provided a retainer in which a nail clipper can be easily contained in a protective manner and one in which the nail clipper can be readily exposed for use.

Accordingly, it is an object of the invention to provide a retainer for a nail clipper which readily receives a nail clipper in a recessed protective manner while permitting the nail clipper to be readily exposed for use.

It is another object of the invention to be able to handle a nail clipper in a relatively safe manner.

It is another object of the invention to protect against inadvertent cuts caused by a nail clipper.

It is another object of the invention to reduce the risk of snagging of a nail clipper in a purse or pocket.

Briefly, the invention provides a retainer for a nail clipper which is of the type which has a pair of elongated legs secured together at a rear end and with each leg having a jaw at the opposite forward end facing a jaw of the other leg.

In accordance with the invention, the retainer is constructed so that the nail clipper is mounted therein for movement between a recessed position and an operating position. In this respect, the retainer includes a rear end which receives the rear end of the nail clipper when in the recessed position. In addition, the retainer has a wall at the forward end for positioning in front of the jaws of the nail clipper when the clipper is in the recessed position while being positioned out of the plane of the jaws (i.e. spaced from the jaws) in the operating position of the forward end of the nail clipper. Still further, the retainer includes a stop means at the forward end for retaining the nail clipper in the retainer when in the operating position.

The retainer is made of any suitable material such as a plastic. In addition, the retainer has a body of skeletal construction with a pair of side walls receiving the nail clipper therebetween. In this respect, the side walls may diverge from each other so as to conform with the shape of the nail clipper which typically has legs which are of a divergent or tapered shape. In addition, the retainer has an elongated opening in the bottom to permit manual pushing of the forward end of the nail clipper from the recessed position to the operating position.

In one embodiment, the retainer is provided with a U-shaped ledge at the rear end for receiving the rear end of the nail clipper thereon when the nail clipper is in the operating position. In this respect, the U-shape of the ledge provides a space to receive a securing rivet of the nail clipper which is used to secure the two legs of the nail clipper together at the rear end.

The retainer body also has a ledge at the forward end to receive the forward end of the nail clipper thereon when in the recessed position. In addition, this ledge is provided with a semi-circular recess so as to receive a circular head of a post normally used in the nail clipper to mount an operating lever thereon.

The retainer body is provided with an internal recess at the rear end for receiving the rear end of the nail clipper when in the recessed position. The retainer body also has a shoulder at the rear end adjacent the recess to abut the rear end of the nail clipper when the clipper is in the operating position. This shoulder is spaced from the wall at the front end of the retainer a distance which is slightly less than the length of the nail clipper to permit the jaws of the nail clipper, when in the operating position, to project over the wall of the retainer.

The wall at the forward end of the retainer may also be provided with a rounded lip for receiving a fingertip during a nail cutting operation. In addition, the retainer may be provided with a finger grip which extends from the rear end to facilitate manipulation of the nail clipper and retainer during use.

The stop means which are provided to retain the nail clipper in place when in the operating position may include a pair of projections, each of which extends from a respective side wall of the retainer towards the opposite side wall.

When the nail clipper is to be stored, for example in a pocket or purse, the forward end of the nail clipper is placed in the recessed position within the retainer. In this regard, the rear end of the nail clipper is received in the recess formed at the rear end of the retainer while the jaws at the forward end of the nail clipper are behind and located in the plane of the wall at the front of the retainer. In this position, the sharp jaws are not exposed.

Should one desire to use the nail clipper, the forward end of the nail clipper is simply raised relative to the front wall of the retainer to move away from the ledge at the forward end against the stop means. Next, the nail clipper is pushed forward while the rear end is pushed down so that the rear end of the clipper moves out of the recess at the rear end of the retainer into a position abutting the shoulder at the rear end of the retainer. The nail clipper is thus brought into the operating position. At this time, the jaws at the front end of the nail clipper are exposed to view and use. A person may then place a fingertip on the rounded lip of the wall and the nail on the finger between the jaws of the nail clipper. At this time, the nail clipper may be actuated in a conventional manner to trim the nail on the finger.

During a cutting operation, the nail clippings pass into the space located between the two elongated legs of the nail clipper. Since the side walls of the retainer slidably receive the nail clipper in friction-fit manner, a chamber is thus defined to store the clippings over a period of time.

When the nail clipper is no longer to be used, the forward end of the nail clipper is simply pressed down and back into the recessed position so that the jaws take up a position behind the front wall of the retainer. In this regard, the rear end of the nail clipper slides up out of abutment with the shoulder and moves into the recess at the rear end of the retainer. In this way, the nail clipper is returned to the recessed or closed position.

Should a need arise to remove the nail clipper from the retainer, for example to clean out the clippings accumulated within the chamber defined, in part, between the clipper legs, the rear end of the clipper is moved forward and is raised out of the retainer. For example, by pushing up through the rear of the opening in the bottom of the retainer, the rear end of the clipper can be raised out of the plane of the retainer. Thereafter, the remainder of the nail clipper may be easily slid out of the retainer.

In order to reposition the clipper within the retainer, the forward end of the nail clipper is slid into the retainer and thereafter, the rear end of the clipper is pivoted downwardly until into alignment with the recess. The clipper is then moved rearwardly to move the rear end of the clipper into the recess in the retainer.

The retainer may also be provided with a finger grip which extends from the rear end in order to facilitate manual handling of the retainer and nail clipper combination when the nail clipper is to be placed in operation.

The retainer is sized so that the nail clipper can be recessed therein completely within the plane of the side walls of the retainer. In this way, all surfaces of the nail clipper can be encased. In particular, when in the recessed position, the sharp jaws are completely surrounded by the retainer and held therein in a reliable manner.

The nail clipper can be readily presented for use by a simple upward pivoting of the front end of the nail clipper with a forward motion from the recessed position to the raised operating position. In like manner, the nail clipper may be readily removed by pivoting of the rear end out of the retainer with subsequent removal of the nail clipper. This permits ready access to the space between the legs of the nail clipper to clean out any accumulated clippings therein.

In another embodiment, the retainer is provided with a ledge at the rear end and an upstanding post on the ledge. In this embodiment, the nail clipper has a hollow rivet securing the legs of the clipper together at the rear end. In addition, the hollow rivet is slidably mounted on the post for pivoting of the nail clipper between the recessed position and the operating position.

These and other objects and advantages of the invention will become more apparent from the following detailed description taken in conjunction with the accompanying drawings wherein:

FIG. 6 illustrates a view similar to FIG. 2 with the nail clipper in an operating position;

FIG. 7 illustrates an exploded view of the nail clipper and retainer;

FIG. 8 illustrates a top view of the retainer of FIG. 1;

FIG. 9 illustrates a view of a modified embodiment of a retainer in accordance with the invention;

FIG. 10 illustrates an exploded view of the nail clipper and retainer of the second embodiment; and FIG. 11 illustrates a top view of the retainer of FIG. 10.

Figure 1:
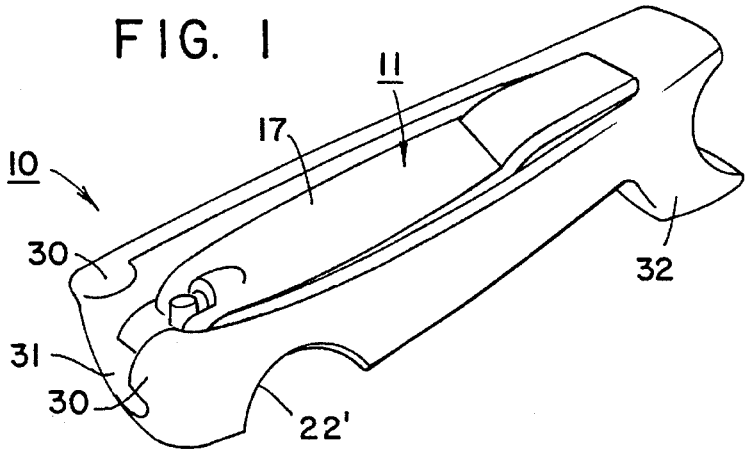
FIG. 1 illustrates a perspective view of a retainer having a nail clipper received therein in accordance with the invention.

Referring to FIG. 1, the retainer 10 is sized to receive a nail clipper 11 which, in turn, may be sized, for example for use as a finger nail clipper, toe nail clipper or the like. The retainer 10 receives the nail clipper 11 so that the clipper 11 is movable between a recessed position shown in FIG. 2 and an operating position as shown in FIG. 6.

Referring to FIGS. 6 and 7, the nail clipper 11 is constructed in a conventional manner and need not be described in detail. For example, the nail clipper 11 includes a pair of elongated legs 12, each of which is secured to the other at one end by a hollow rivet 13. In addition, each leg 11 has a jaw 14 at the opposite forward end disposed in spaced facing relation to a jaw 14 on the other leg 12. Each jaw 14 carries a sharp edge 15 which is suitably shaped and sized for the clipping of nails.

As indicated, the nail clipper 11 includes a post 16 which is secured to the lower bar 12, as viewed, in rotatable manner and which passes through the upper leg 12 as well as a means for moving the jaws 14 relative to each other, for example a means in the form of an actuating arm or lever 17 which is pivotally mounted on the post 16 via a bar 18 which is received in a notch 19 in the post 16. In this respect, the actuating arm 17 can be moved from the position as shown in FIG. 1 to the position as shown in FIG. 6 for moving the legs 12 together in a conventional manner via a cam 20 on the arm 19. As indicated, the actuating arm 17 is bent to effect the pivoting action of the legs 12. As also shown in FIG. 6, the post 16 has a rounded head 21 at the lower end which abuts against the lower leg 12.

Figure 4:
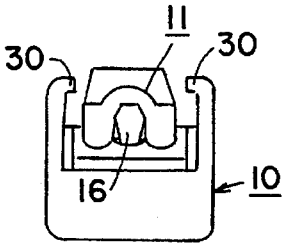
FIG. 4 illustrates a front view of the retainer with the nail clipper in the recessed position.
Figure 5:
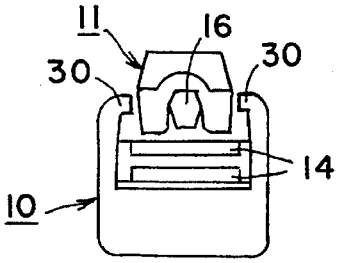
FIG. 5 illustrates a front view of the retainer with the nail clipper in a raised position for use in accordance with the invention.

Referring to FIGS. 7 and 8, the retainer 10 is made of a one-piece body of skeletal construction, for example of plastic. As illustrated, the retainer 10 has a pair of side walls 22 which are disposed in angular relationship to each other as indicated in FIG. 8 to accommodate the shape of the nail clipper 11. As indicated in FIGS. 4 and 5, the side walls 22 receive the nail clipper 11 therebetween in a friction fit relation.

Figure 2:
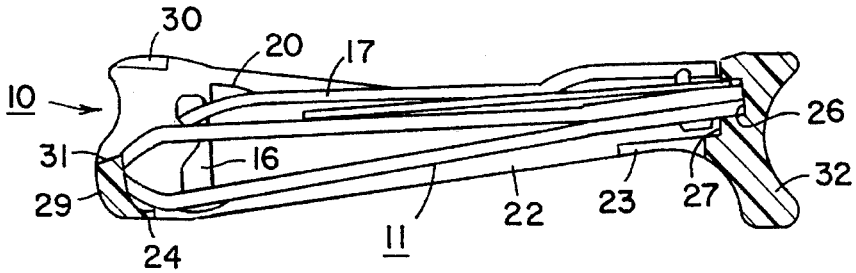
FIG. 2 illustrates a cross-sectional view of the retainer of FIG. 1 with the nail clipper in a recessed position.
Figure 3:
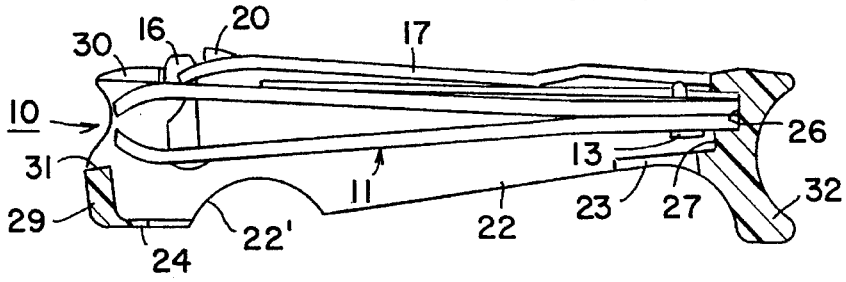
FIG. 3 illustrates a view similar to FIG. 2 with the nail clipper in an intermediate position.

Referring to FIGS. 2 and 3, the side walls 22 of the retainer 10 are shaped so as to retain the nail clipper 11 in a recessed condition (see FIG. 2). That is, the nail clipper 11 is retained substantially within the plane of the side walls 22. As indicated, each side wall 22 is provided with a recess 22' of generally hemispherical shape to permit manual pushing of the pulley into the nail clipper from the recessed position to the operating position. Each recess 22' is sized so that the nail clapper 11 projects into the plane of the recesses 22' when in the recessed position as indicated in FIG. 2.

As shown in FIGS. 7 and 8, the retainer 10 has an elongated opening in bottom which communicates with the recesses 22' in the side walls 22 to permit manual pushing of the forward end of the nail clipper 11 from the recessed position as illustrated in FIG. 2 to a raised position as illustrated in FIG. 3. In addition, a U-shaped ledge 23 is provided along the bottom of the retainer 10 at the rear end so as to receive the rear end of the nail clipper 11 in abutting relation when in the operating position. The U-shape of the ledge 23 also permits the rivet 13 of the nail clipper to be received therein. A second ledge 24 is provided along the bottom of the retainer 10 at the forward end to receive the forward end of the nail clipper 11 thereon when in the recessed position. This forward ledge 24 is provided with a semicircular cut-out 25 to receive the head 21 of the post 16 of the nail clipper.

Referring to FIG. 2, the retainer 10 has a recess 26 at the rear end for receiving the rear end of the nail clipper 11. As indicated, the recess 26 is defined, in part, by a shoulder 27 of the retainer body. A second recess is also provided between the shoulder 27 and ledge 23 within the body of the retainer 10 forwardly of the recess 26. In addition, the retainer 10 has a wall 29 at the forward end for positioning in front of the jaws 14 of the nail clipper 11 when the nail clipper is in the recessed position as shown in FIGS. 2 and 4. A stop means 30 is also provided at the forward end of the retainer 10 for retaining the forward end of the nail clipper 11 in the retainer 10 in the raised intermediate position as indicated in FIG. 3 and the operating position as indicated in FIG. 5. As illustrated, the stop means 30 is formed by a pair of projections each of which extends from a respective side wall 22 towards the opposite side wall. As shown in FIG. 2, the projections 30 are spaced from the front wall 29 to define an opening therebetween to expose the jaws 14 of the nail clipper 11 when in the positions as indicated in FIGS. 3 and 5.

The shoulder 27 is spaced from the wall 29 by a distance which is less than the length of the nail clipper 11 so as to permit projection of the jaws 14 of the nail clipper 11 in the operating position over the wall 29 of the retainer 10.

In order to move the nail clipper 11 from the recessed position shown in FIG. 2 to the operating position of use as shown in FIG. 6, finger pressure is applied under the forward end of the nail clipper 11 to move the nail clipper 11 upwardly (as viewed) relative to the front wall 29 into the intermediate position shown in FIG. 3 abutting the shoulders 30. Next, the clipper 11 is pushed forwardly out of the recess 26 and down onto the ledge 23 so that the rear end of the clipper 11 abuts the shoulder 27 as shown in FIG. 6 and the,jaws 14 project over the wall 29. When in the raised operating position, the arm 17 of the nail clipper 11 is accessed to be pivoted into a position as shown in FIG. 6. A fingernail may then be cut in the usual fashion.

The wall 29 at the forward end of the retainer 10 has a rounded front lip 31 which serves to accommodate a finger of a user so as to facilitate clipping of the fingernail.

Referring to FIG. 1, the retainer 10 is also provided with a finger grip 32 which extends from the rear end. As indicated, the finger grip 32 is formed as a projection which extends downwardly and slightly rearwardly of the retainer 10. This projection 32 is rounded on the inside face so as to comfortably receive a finger while also having a rounded recess on the rear end of the retainer.

Referring to FIG. 6, when nails are cut, the clippings can be retained in the space defined between the two legs 12 of the nail clipper 11 and the two side walls 22 of the retainer 10. Thereafter, from time to time, the nail clipper 11 may be removed from the retainer 10 so as to permit removal of the nail clippings from between the legs 12 of the nail clipper 11. In this respect, in order to remove the nail clipper 11, for example from the recessed position shown in FIG. 3, manual pressure is applied to the forward end of the nail clipper 11 to raise the forward end into the raised position as indicated in FIG. 3. Thereafter, the clipper 11 is moved forwardly and the rear end of the nail clipper is manually pushed out of the retainer 10 while the forward end pivots about the projections 30 at the forward end of the retainer 10. Thereafter, the remainder of the nail clipper 11 can be easily slid out of the retainer 10.

In order to return the nail clipper 11 into position, the forward end of the nail clipper can be inserted into the retainer 10 so that the jaws 14 are disposed behind the front wall 29 of the retainer 10. The nail clipper 11 can then be pivoted about the forward end so that the rear end moves into the retainer 10 into alignment with the recess 26 followed by sliding of the clipper 11 rearwardly into the recess 26.

Referring to FIGS. 9 to 11, wherein like reference characters indicate like parts as above, the retainer 10' may be constructed to avoid the need to push the nail clipper 11 forwardly when moving the nail clipper 11 into an operating position. To this end, a ledge 23' is provided along the bottom of the retainer 10' at the rear end so as to receive the rear end of the nail clipper 11 in abutting relation when in the recessed position as well as in the operating position. As shown in FIG. 11, the ledge 23' is of rectangular or trapezoidal shape.

In addition, an upstanding post 33 is provided on the ledge 23' to slidably receive the hollow rivet 13 of the nail clipper 11 in a manner to permit the nail clipper 11 to move between a recessed position (not shown) and an operating position as shown in FIG. 9.

As shown in FIG. 9, when the nail clipper 11 is in the operating position, the rear end of the nail clipper 11 is abutted against a wall of the retainer. That is, the retainer 10 need not be provided with a recess at the rear end to receive the nail clipper 11. Accordingly, molding of the retainer 10 can be simplified.

In order to remove the nail clipper 11 from the retainer 10', the clipper is moved into the operating position as shown in FIG. 9. Thereafter, the rear end of the nail clipper 11 is pushed upwardly off the post 33 so that the rear end of the nail clipper 11 is raised out of the retainer 10'. The nail clipper 11 may then be slid from under the abutments 30 for removal. Re-insertion of the nail clipper into the retainer 10' occurs in a reverse manner.

Of note, the abutments 30 on the side walls 22 may be positioned along the side walls 22 so as to project between the jaws 14 of the nail clipper 11. For example, with the nail clipper 11 in the recessed condition, the abutments would abut the underside of the upper jaw 14. When the nail clipper 11 is in the raised operating position, the abutments would contact the top side of the lower jaw 14. In order to facilitate removal of the nail clipper, the abutments may be in the form of wedges.

The invention thus provides a retainer for housing a nail clipper in a covered manner so that the sharp edges of the jaws of the nail clipper are not exposed. The invention further provides a retainer of relatively lightweight construction which can be readily handled.

The invention further provides a nail clipper housing from which a nail clipper can be readily removed for cleaning purposes or the like.

The invention further provides a nail clipper retainer which permits a nail clipper to be retained in a protected manner and to be manipulated readily into a position of use.

The retainer can be embellished so as to enhance the aesthetic appearance of the retainer. For example, the retainer may be made in various colors.

What is claimed is:

1. In combination, a nail clipper having a pair of elongated legs secured together at a rear end, each of said legs having a jaw at an opposite forward end facing a jaw of the other of said legs; and a retainer having said nail clipper mounted therein for movement between a recessed position and an operating position, said retainer including an elongated body having a rear end receiving said rear end of said nail clipper in said recessed position, a wall at a forward end for positioning in front of said jaws in said recessed position of said nail clipper and stop means at said forward end for retaining said nail clipper in said retainer in said operating position, said stop means being spaced from said wall to define an opening therebetween to expose said jaws in said operating position of said nail clipper.

2. The combination as set forth in claim 1 wherein said retainer is of skeletal construction having a pair of side walls receiving said nail clipper therebetween.

3. The combination as set forth in claim 2 wherein said stop means includes a pair of projections, each of said projections extending from a respective one of said side walls towards the other of said side walls.

4. The combination as set forth in claim 2 wherein said retainer has an elongated opening in a bottom thereof and a recess in each of said side walls communicating with said opening to permit manual pushing of said forward end of said nail clipper from said recessed position to said operating position.

5. The combination as set forth in claim 4 wherein said elongated opening of said retainer is sized to slidably receive said clipper.

6. The combination as-set forth in claim 1 wherein said retainer has an internal recess at said rear end of said body for receiving said rear end of said nail clipper in said recessed position and a shoulder at said rear end of said body positioned forwardly of said recess for abutment of said rear end of said nail clipper thereon in said operating position.

7. The combination as set forth in claim 6 wherein said shoulder is spaced from said wall a distance less than the length of said nail clipper to permit projection of said jaws of said nail clipper in said operating position over said wall.

8. The combination as set forth in claim 7 wherein said wall of said retainer has a rounded lip for receiving a finger tip thereon.

9. The combination as set forth in claim 1 wherein said nail clipper has a hollow rivet securing said legs together at said rear end of said Clipper and wherein said retainer has a post at said rear end of said body slidably receiving said rivet for movement of said nail clipper between said recessed position and said operating position.

10. The combination as set forth in claim 1 wherein said retainer has a finger grip extending from said rear end of said body.

11. The combination as set forth in claim 1 wherein said retainer is made of plastic.

12. The combination as set forth in claim 1 wherein said retainer body has a ledge at said rear end of said body receiving said rear end of said nail clipper thereon in said operating position.

13. In combination, a nail clipper having a pair of elongated legs secured together at a rear end, each of said legs having a jaw at an opposite end facing a jaw of the other of said legs; and a retainer having said nail clipper removably mounted therein for movement between a recessed position and an operating position, said retainer including a rear end receiving said rear end of said nail clipper in said recessed position, a wall at a forward end for positioning in front of said jaws in said recessed position and spaced from said jaws in said operating position of said nail clipper and stop means for retaining said nail clipper in said retainer in said operating position.

14. The combination as set forth in claim 13 wherein said retainer is of skeletal construction having a pair of side walls receiving said nail clipper therebetween.

15. The combination as set forth in claim 14 wherein said stop means includes a pair of projections, each of said projections extending from a respective one of said side walls towards the other of said side walls.

16. The combination as set forth in claim 13 wherein said retainer has an elongated opening in a bottom thereof to permit manual pushing of a forward end of said nail clipper from said recessed position to said operating position.

17. The combination as set forth in claim 13 wherein said retainer has an internal recess at said rear end thereof for receiving said rear end of said nail clipper in said recessed position and a shoulder at said rear end of said body adjacent said recess, said shoulder being spaced from said wall a distance less than the length of said nail clipper to permit projection of said jaws of said nail clipper in said operating position over said wall.

18. The combination as set forth in claim 13 wherein said retainer has a pair of side walls receiving said nail clipper therebetween in friction fit relation, each of said side walls having a recess to permit manual pushing of said nail clipper from said recessed position to said operating position.

19. The combination as set forth in claim 13 wherein said retainer has a ledge at said rear end thereof receiving said rear end of said nail clipper thereon in said operating position.

20. The combination as set forth in claim 19 wherein said retainer body has a post on said ledge and said nail clipper has a hollow rivet securing said legs together and slidably received on said post.

* * * * *